US006272782B1

(12) United States Patent
Dittrich et al.

(10) Patent No.: US 6,272,782 B1
(45) Date of Patent: Aug. 14, 2001

(54) CARTRIDGE MAGAZINE DISPLACEMENT MECHANISM FOR AN EXPLOSIVE POWDER CHARGE-OPERATED SETTING TOOL

(75) Inventors: Tilo Dittrich, Gisingen (AT); Stefan Bönig, Wasserburg (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/479,612

(22) Filed: Jan. 7, 2000

(30) Foreign Application Priority Data

Jan. 15, 1999 (DE) ..... 199 01 268

(51) Int. Cl.[7] ..... F41A 9/61; B25C 1/08

(52) U.S. Cl. ..... 42/6; 227/9

(58) Field of Search ..... 227/10, 9; 42/6, 42/5

(56) References Cited

U.S. PATENT DOCUMENTS 3,050,892 * 8/1962 Vogler et al. ..... 42/5
4,077,556 * 3/1978 Buchel ..... 227/8
4,375,269 * 3/1983 Bosch et al. ..... 227/8
4,821,938 * 4/1989 Haytayan ..... 227/10

FOREIGN PATENT DOCUMENTS 2044920 3/1972 (DE) .
0042063 5/1981 (EP) .

* cited by examiner

*Primary Examiner*—Charles T. Jordan
*Assistant Examiner*—John W. Zerr
(74) *Attorney, Agent, or Firm*—Sidley Austin Brown & Wood, LLP

(57) ABSTRACT

A cartridge magazine displacement mechanism for a charge-operated setting tool and including a spring-biased transfer member (13) pivotable about a first pivot (15), cooperating with the trigger (6) and displaceable substantially parallel to an actuation direction of the trigger (6), a spring-biased, one-arm displacement lever (7) cooperating with a free end of the transfer member (13), pivotable about a second pivot (8) fixedly secured in the setting tool housing, and having an engaging dog (12) provided at a free end of the displacement lever displaceable substantially parallel to a longitudinal extent of the cartridge channel of the setting tool, and engageable in or liftable off the cartridge channel, with the first pivot (15) being arranged on the displacement lever (7) between the second pivot and the engaging dog.

7 Claims, 3 Drawing Sheets

CARTRIDGE MAGAZINE DISPLACEMENT MECHANISM FOR AN EXPLOSIVE POWDER CHARGE-OPERATED SETTING TOOL

BACKGROUND OF THE INVENTION

1. Field of the Invention

The present invention relates to a cartridge magazine displacement mechanism for an explosive powder charge-operated setting tool and including a spring-biased transfer member pivotable about a first pivot, cooperating with the trigger and displaceable substantially parallel to actuation direction of the trigger, a spring-biased, one-arm displacement lever cooperating with a free end of the transfer member, pivotable about a second pivot fixedly secured in the setting tool housing, and having an engaging dog provided at a free end of the displacement lever, displaceable substantially parallel to a longitudinal extent of the cartridge channel, and engageable in and liftable of the cartridge channel.

2. Description of the Prior Art

For driving, e.g., nail-shaped fastening elements in a hard constructional component formed of stone, concrete, steel and the like, explosive power charge-operated setting tools are used. Such a setting tool is disclosed, e.g., in German Publication DE 20 44 920. The setting tool disclosed in the German Publication has a trigger which cooperates with a spring-biased transfer member formed as a one-arm lever pivotable about a first pivot fixedly secured in the setting tool housing. The free end of the transfer member is provided with a cam which cooperates with a control track provided on a spring-biased displacement lever pivotable about a second pivot likewise fixedly secured in the setting tool housing. The free end of the displacement lever is provided with an engaging dog engagable in and liftable off the cartridge channel of the setting tool.

Upon actuation of the trigger, the cam provided on the transfer member slides over the control track provided on the displacement lever and preloads the same. Because of a large friction between the cam and the control track, a significant force is required for the actuation of the trigger. This leads to signs of fatigue in the operator soon after he starts working.

Accordingly, an object of the present invention is to provide cartridge magazine displacement mechanism which can be operated in a simple and reliable manner and does not require that a significant force be applied to the trigger for actuating the setting tool.

Another object of the present invention is to provide a cartridge magazine displacement mechanism that becomes preloaded upon actuation of the trigger after the setting tool was pressed against a constructional component, and that advances the cartridge magazine when the setting tool is lifted off the constructional component.

SUMMARY OF THE INVENTION

These and other objects of the present invention, which will become apparent hereinafter, are achieved by locating the first pivot on the displacement lever between the second pivot and the engaging dog.

The substantially friction-free connection between the transfer member and the displacement lever insures that a small force is necessary for the actuation of the trigger which, in turn, insures a fatigue-free operation of the setting tool by the operator.

The arrangement of the first pivot on the displacement lever depends on the size of the displacement path of the trigger and on the displacement path of the engaging dog. Preferably, the distance between the first and second pivots corresponds to 0.15–0.5 times of the distance between the engaging dog and the second pivot.

In order to be able to prevent the advancement of the cartridge magazine in setting tools with an automatic feed of the fastening elements until another fastening element is fed into a guide tube of the setting tool, advantageously, the transfer member cooperates with a locking lever pivotable about a third pivot provided in the housing.

Cooperation means here, e.g., an axial positioning of the transfer member and, thereby, of the displacement lever in the preloaded condition. To provide for the proper positioning, the transfer member, advantageously, has a stop rim that cooperates with a locking lever.

In order to provide for pivotal movement of the locking lever dependent on the pressing path of the setting tool, preferably, the locking lever is pivoted by a pressure pin displaceable parallel to the setting direction of the setting tool.

E.g., in order to provide for a pivotal movement of the locking lever, which is arranged sidewise of the pressure pin, upon a longitudinal displacement of the pressure pin, preferably, the pressure pin is provided with a control member for displacing the locking lever.

Simple and reliable actuation of the locking lever is achieved when the control member is provided, e.g., with a projection which cooperates with a control track formed on the locking lever.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
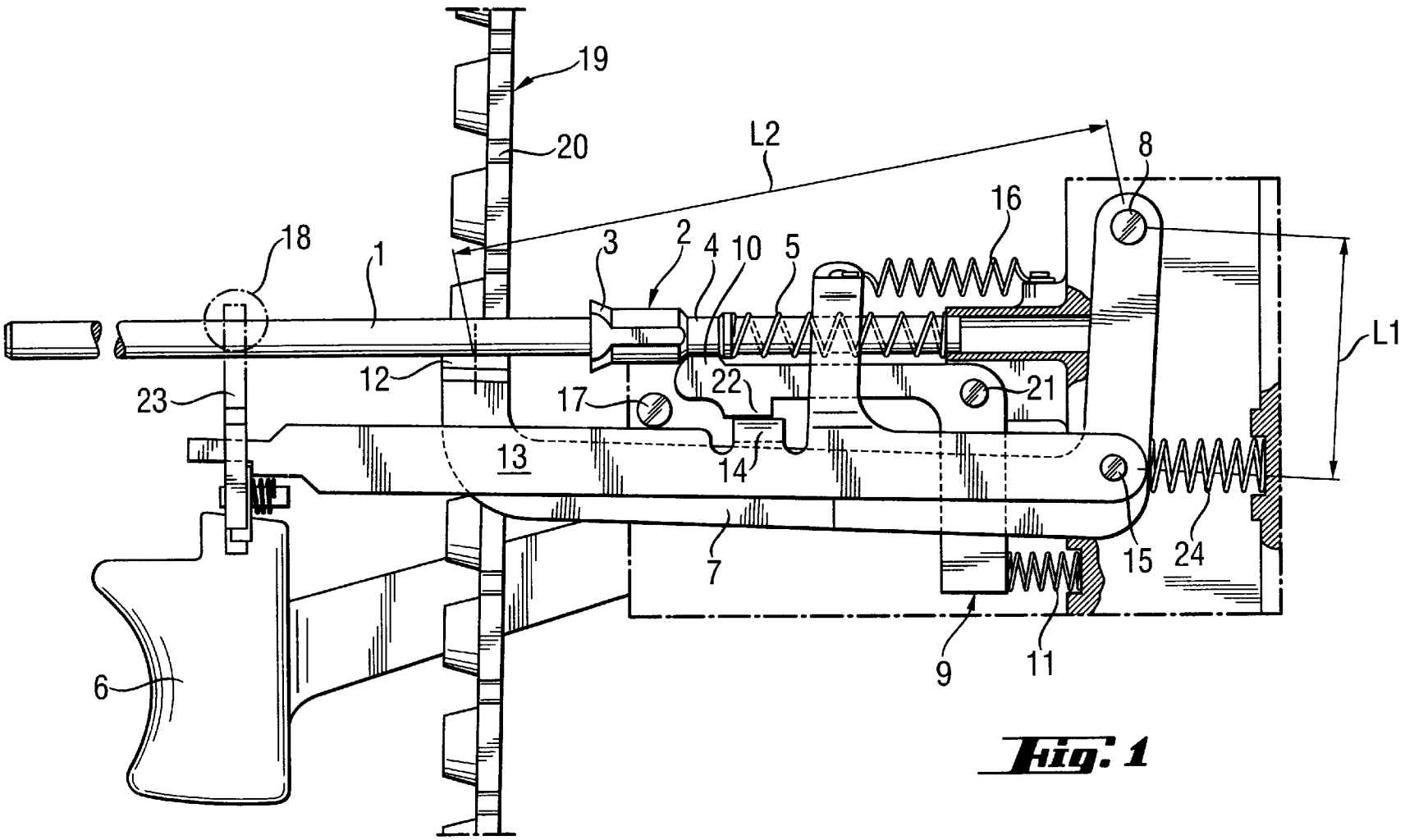
FIG. 1 a side elevational view of a cartridge magazine displacement mechanism according to the present invention for an explosive powder charge-operating setting tool, illustrating an initial position of the displacement mechanism.
Figure 2:
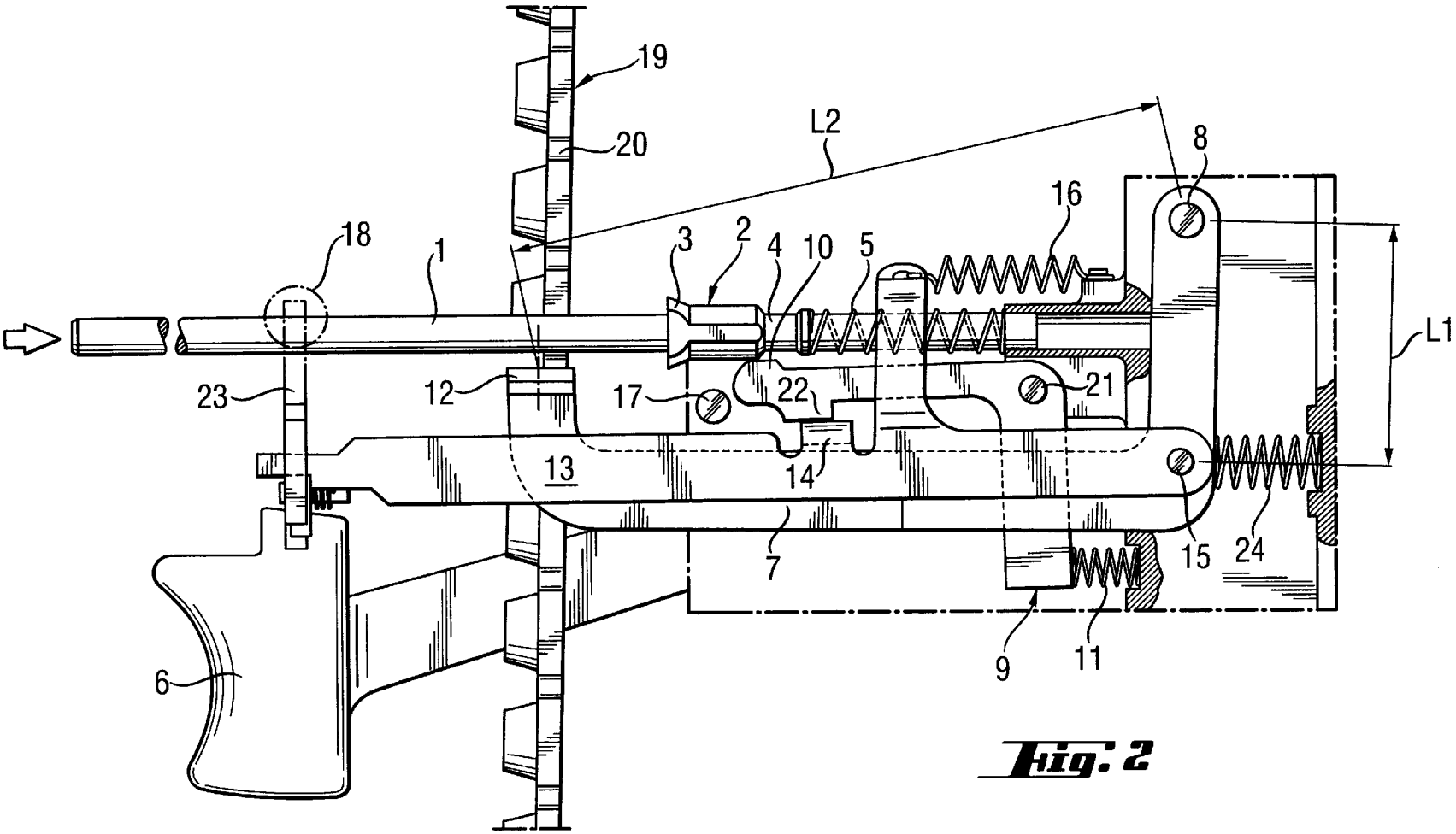
FIG. 2 a view similar to that of FIG. 1, illustrating the position of the displacement mechanism when the setting tool is pressed against a constructional component.
Figure 3:
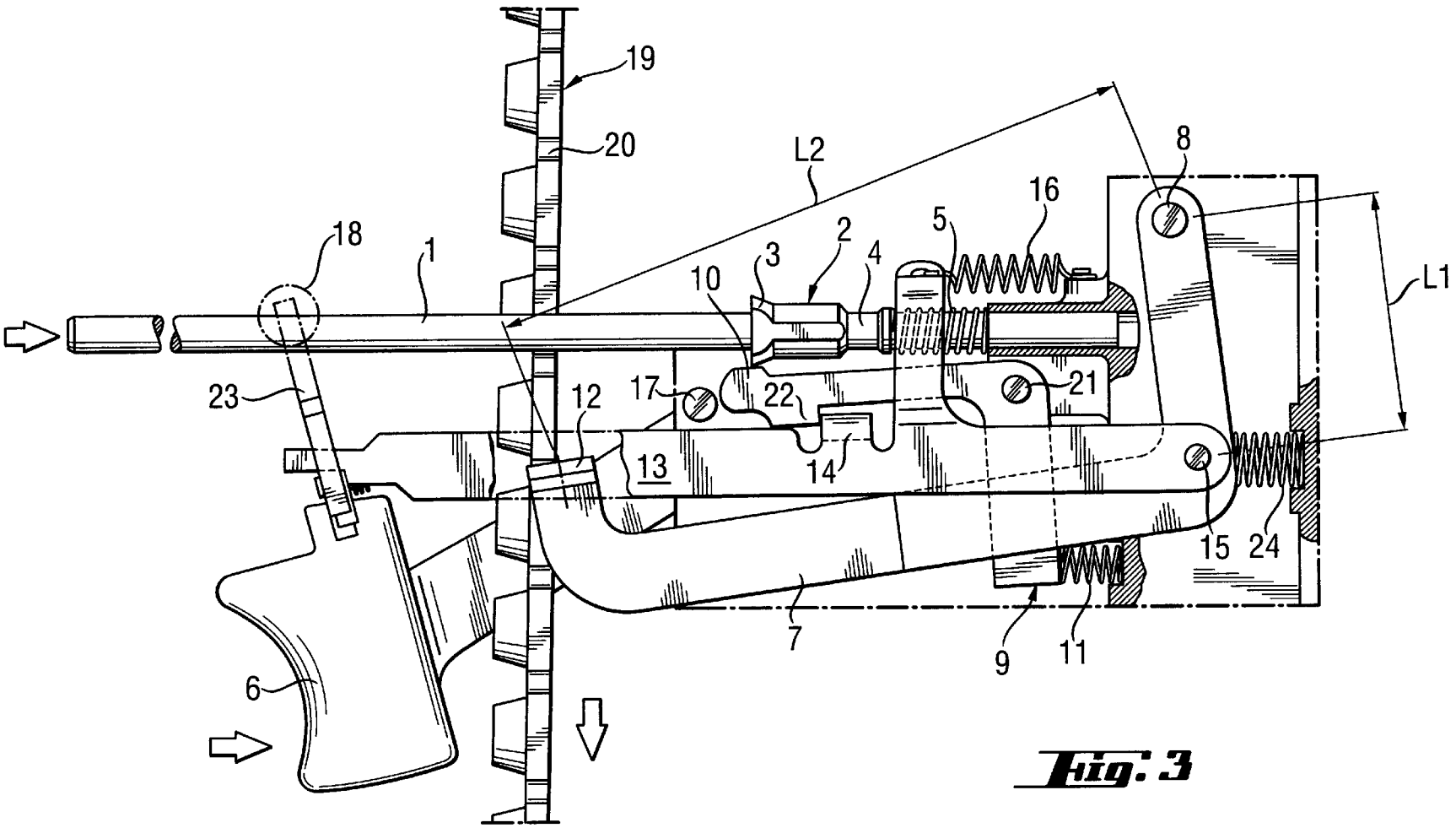
FIG. 3 a view similar to those a FIGS. 1 and 2, illustrating the position of the displacement mechanism when the setting tool is in its pressed-against condition and the trigger is actuated.

A displacement mechanism for displacing cartridge magazine 19, which is shown in FIGS. 1–3, forms part of an explosive powder charge-operated setting tool, not shown in detail, that includes a housing, a handle connected with the housing, and a trigger 6 arranged in the handle and pivotable about a pivot axle 18. The displacement mechanism includes a displacement lever 7 pivotable about a second pivot 8 and a transfer member 13 pivotable about a first pivot 15 provided on the displacement lever 7. The transfer member 13 pivots against a biasing force of a spring 16. In its initial position, the transfer member 13 is supported against a stop 17 provided in the setting tool housing.

The distance (L1) between the first pivot 15, which is provided on the displacement lever 7, and the second pivot 8, about which the displacement lever 7 pivots, corresponds to 0.15 to 0.5 time of the distance (L2) between the second pivot 8 and a engaging dog 12 of the displacement lever 7. The displacement lever 7 is formed as a U-shaped part with legs having different lengths. The second pivot 8 is arranged in the end region of the first longer leg, and the engaging dog 12 is arranged in the end region of the second shorter leg. The engaging dog 12 engages in the notches 20 of the cartridge magazine 19 and effect the advancing of the cartridge magazine 19. The first pivot 15 is located in the end region of the first longer leg that is opposite to the end region in which the second pivot 8 is located.

The transfer member 13 has a reduced width at its free end, with the free end extending through an opening formed in a support 23 for the trigger 6. The free end of the transfer member 13 is displaceable in the opening formed in the support 23 parallel to the longitudinal extent of the cartridge magazine 19.

The transfer member 13 has a stop rim 14 which, in the depressed condition of the trigger 6, formlockingly cooperates, as shown in FIG. 3, with a stop shoulder 22 of a locking lever 9. The locking lever 9 pivots about a third pivot 21, which is fixed in the setting tool housing, against a biasing force of a spring 11. At its side opposite the stop shoulder 22, the locking lever 9 is provided with a control profile 10 which cooperates with a projection 3 or a notch 4 of a control member 2 axially secured on a pressure pin 1. The pressure pin 1 is displaceable parallel to the actuation direction of the trigger 6 against a biasing force of a compression spring 5. The compression spring 5 has its end facing in direction opposite to the actuation direction of trigger 6, supported against the control member 2 and surrounds the pressure pin 1.

The operation of the displacement mechanism according to the present invention is described below.

When the setting tool is pressed against a constructional component (not shown), the pressure pin 1 becomes displaced in the actuation direction of the trigger 6. Upon displacement of the pressure pin 1, the control member 2, which is supported on the pressure pin 1, pivots the locking lever 9 and its shoulder 22 about the third pivot 21 in a direction of the transfer member 13, and pivots the transfer member 13 about the first pivot 15 into a preloaded position. Upon actuation of the trigger 6, the preloaded transfer member 13 is displaced into the actuation direction of the trigger 6 so that the shop shoulder 22 formlockingly engages the stop rim 14 of the transfer member 13 sidewide. This preloads the magazine displacement spring 24 which cooperates with the displacement lever 7. Upon release of the trigger 6, the transfer member 13 remains in the locking position. Only after the setting tool is lifted off the constructional component, the pressure pin 1 is displaced into its initial position, releasing the control member 2 of the locking lever 9 and, thereby, the transfer member 13 which returning to its initial position under the action of the spring 16. Upon displacement of the transfer member 13 into its initial position, the displacement spring 24 biases the displacement lever 7 into a position in which it advances the cartridge magazine 9.

Though the present invention was shown and described with references to a preferred embodiment, such is merely illustrative of the present invention and is not to be construed as a limitation thereof and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A cartridge magazine displacement mechanism for an explosive powder charge-operated setting tool including a housing, a cartridge channel, and a trigger (6) for actuating the setting tool, the displacement mechanism comprising a spring-biased transfer member (13) pivotable about a first pivot (15), cooperating with the trigger (6) and displaceable substantially parallel to an actuation direction of the trigger (6); a spring-biased, one-arm displacement lever (7) cooperating with a free end of the transfer member (13), pivotable about a second pivot (8) fixedly secured in the setting tool housing, and having an engaging dog (12) provided at a free end of the displacement lever, displaceable substantially parallel to a longitudinal extent of the cartridge channel, and engageable in and liftable off the cartridge channel, the first pivot (15) being arranged on the displacement lever (7) between the second pivot (8) and the engaging dog (12).

2. A displacement mechanism according to claim 1, wherein the first pivot (15) is spaced from the second pivot (8) by a distance (L1) corresponding to 0.15–0.5 time of a distance (L2) between the engaging dog (12) and the second pivot (8).

3. A displacement mechanism according to claim 1, further comprising a spring-biased locking lever (9) pivotable about a third pivot (21) fixedly secured in the setting tool housing, and wherein the transfer member (13) cooperates with the locking lever (9).

4. A displacement mechanism according to claim 3, wherein the transfer member has a stop rim (14) that cooperates with a stop shoulder (22) of the locking lever (9).

5. A displacement mechanism according to claim 4, further comprising a pressure pin (1) displaceable parallel to a setting direction of the setting tool for pivoting the locking lever (9) about the third pivot (21).

6. A displacement mechanism according to claim 5, wherein the pressure pin (1) has a control member (2) for displacing the locking lever (9).

7. A displacement mechanism according to claim 6, wherein the locking lever (9) has a control profile (10), and the control member (2) of the pressure pin (1) has a projection (3) cooperating with the control profile (10) of the locking lever (9).

* * * * *